United States Patent [19]

Inoue et al.

[11] 4,423,972

[45] Jan. 3, 1984

[54] SERIAL PRINTER

[75] Inventors: Ikutaro Inoue, Takizawa; Kousaki Yanata, Morioka, both of Japan

[73] Assignee: Alps Electric Co., Ltd., Tokyo, Japan

[21] Appl. No.: 369,213

[22] Filed: Apr. 16, 1982

[30] Foreign Application Priority Data

Apr. 17, 1981 [JP] Japan ..... 56-58066

[51] Int. Cl.[3] ..... B41J 1/50

[52] U.S. Cl. ..... 400/155; 400/157.1; 400/322; 400/568; 400/569; 400/903

[58] Field of Search ..... 400/154, 154.1, 154.4, 400/154.5, 155, 156.2, 156.3, 157.1, 157.2, 185, 470, 471, 568, 569, 187, 902, 903, 320, 322; 178/34, 35, 32, 41

[56] References Cited

U.S. PATENT DOCUMENTS

| | | | |
|---|---|---|---|
| 2,375,541 | 5/1945 | Dirkes et al. | 178/34 X |
| 2,769,029 | 10/1956 | Howard | 178/35 |
| 3,695,410 | 10/1972 | Kapp | 197/55 |
| 3,743,073 | 7/1973 | Perez | 197/55 |
| 3,760,926 | 9/1973 | Bath et al. | 197/55 |
| 3,807,542 | 4/1974 | Jung | 197/55 |
| 3,823,807 | 7/1974 | Suzuki | 197/55 |
| 3,880,016 | 4/1975 | Jamieson et al. | 400/568 X |
| 3,941,228 | 3/1976 | Keiser | 197/18 |
| 3,952,853 | 4/1976 | Feldman | 197/55 |
| 3,957,151 | 5/1976 | Kashio | 400/154.5 |
| 4,039,067 | 8/1977 | Kashio | 197/49 |
| 4,051,942 | 10/1977 | Suzuki et al. | 197/49 |
| 4,272,204 | 6/1981 | Quinn, Jr. et al. | 400/320 |
| 4,352,576 | 10/1982 | Hori et al. | 400/154.4 |

*Primary Examiner*—Edgar S. Burr
*Assistant Examiner*—Charles A. Pearson
*Attorney, Agent, or Firm*—Guy W. Shoup; Gerard F. Dunne

[57] ABSTRACT

A small and light-weight serial printer adapted to portable electric-powered typewriters and output devices of personal computers. The serial printer of the present invention requires a reduced number of drive sources and is simply constructed. The serial printer further possesses a small and light-weight carriage which does not mount drive sources such as motors or electromagnets and which does not mount a hammering mechanism, either.

6 Claims, 7 Drawing Figures

SERIAL PRINTER

BACKGROUND OF THE INVENTION

1. Field of the Invention

The present invention relates to a serial printer, and more specifically to a serial printer of the type for impact printing in which a carriage carrying a cylindrical type carrier is moved in a direction traverse to the record paper, and the paper is pressed against a selected type on the periphery of the type carrier at each of the positions to which the carriage is moved thereby to effect printing.

2. Prior Art

Serial printers of this type produce vividly printed characters, and enable ordinary paper to be used, and have hence been widely used for electric typewriters and output devices of electronic computers. The serial printers can be grouped into those employing a so-called daisy wheel for carrying the type, and those employing a type-carrying cylinder that can be moved up and down and that can further be rotated.

In the former printer employing the daisy wheel, however, a motor for rotating the type wheel, a hammer and electromagnetic means for driving the hammer are mounted on the carriage that supports the type wheel. Therefore, the carriage inevitably becomes bulky, and the motor for shifting the carriage becomes bulky, too. Moreover, drive sources (motors or electromagnetic devices) are required for selecting the types, for moving the carriage, for driving the hammer and for feeding the paper, resulting in an increase in the size of the printer as a whole and also an increase of weight. Consequently, the printer cannot easily be made portable, and is expensive.

In the latter printer employing the type cylinder, drive sources must also be independently provided for moving the type cylinder up and down, for rotating the type cylinder, for moving the carriage, for striking the whole type cylinder against the platen, and for feeding the paper. Therefore, the construction becomes bulky as a whole, manufacturing cost is increased, the weight is increased, and the printer cannot easily be made portable, similarly to the above-mentioned printer.

In order to preclude these defects, a serial printer has been proposed in U.S. patent application Ser. No. 299,551 filed Sept. 4, 1981. This printer has a reduced number of drive sources to shift the type carrier up and down, to rotate the type carrier, to effect hammering, to move the carriage and to feed the paper, all by using a single d-c motor. In the above printer, outputs produced by the combination of many cam groups are selected to selectively perform the above-mentioned operations, in an attempt to reduce the number of drive sources and to provide a printer which is constructed in small size, in reduced weight and at reduced manufacturing costs. In the above printer, however, the type carrier is shifted to a particular position and is also turned to a particular position even when the spacing operation or the backspacing operation is effected. Therefore, the speed of operation is slightly decreased. Moreover, the construction of cam groups becomes relatively complicated. Further, since the hammer and a mechanism for shifting the type carrier up and down are incorporated in the carriage, it is difficult to reduce the weight of the carriage to a level that can be attained when the type carrier only is mounted on the carriage.

SUMMARY OF THE INVENTION

The object of the present invention, therefore, is to provide a serial printer which can be suitably adapted for use with portable electric-powered typewriters.

Another object of the present invention is to provide a small and light serial printer that can be used as an output device for computers, including the smaller personal computers.

A further object of the present invention is to provide a, light and small serial printer which can be constructed easily and inexpensively by reducing the number of drive sources, and simplifying its mechanisms.

Yet a further object of the present invention is to provide a printer having a small and light carriage which does not carry such drive sources as motors or electromagnets, or which does not even need to carry such a mechanism as a hammer.

BRIEF DESCRIPTION OF THE DRAWINGS

The drawings illustrate a serial printer according to an embodiment of the present invention in which.

DESCRIPTION OF THE PREFERRED EMBODIMENT

Figure 1:
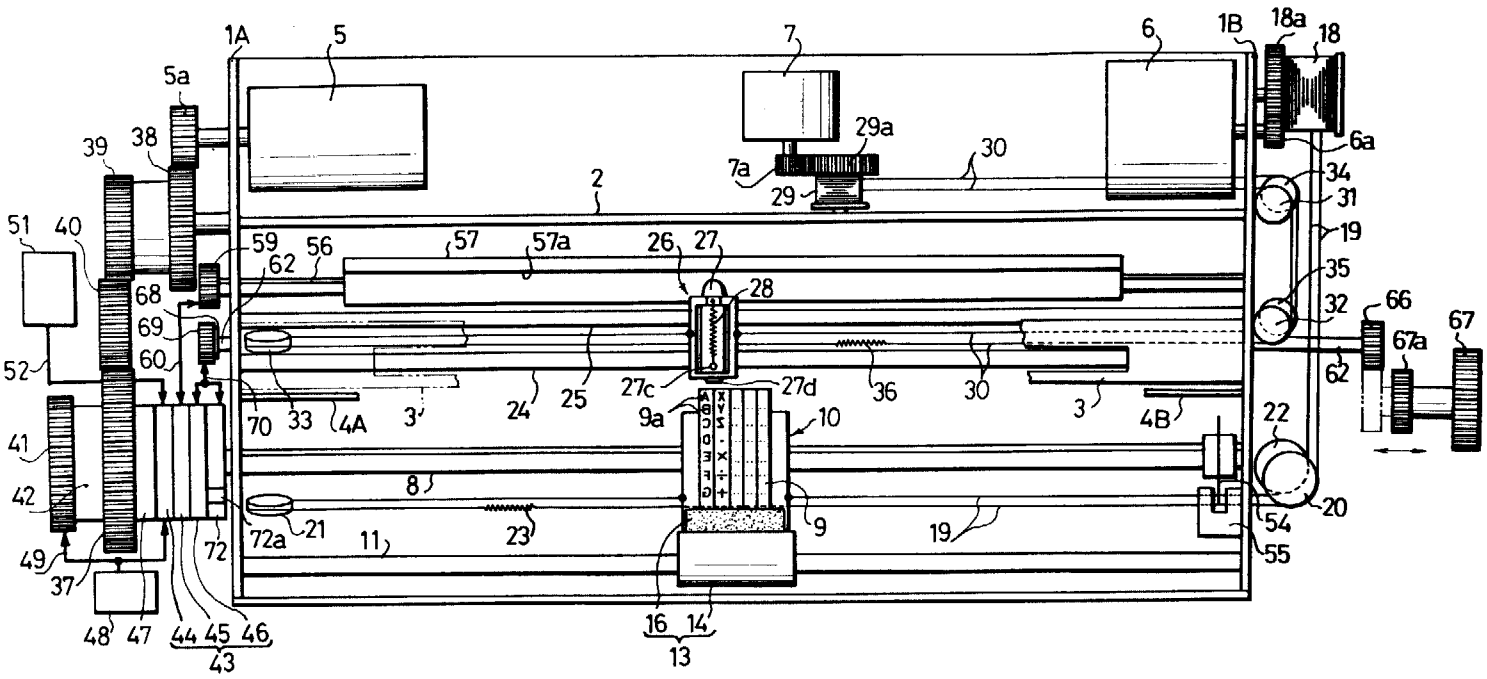
FIG. 1 is a general plan view in which some portions are shown in a simplified manner.

The invention will be described below in detail with reference to an embodiment shown in FIGS. 1 to 5.

The printer according to the present invention measures about 280 mm (width)×125 mm (depth)×40 mm (height), and can thus be incorporated into a portable electric typewriter of an international size of about A4 with a thickness of 50 to 60 mm. For the portable purposes, the printer should desirably be driven by dry cells. The printer, however, may be driven by a so-called rechargeable nickel-cadmium battery or by a commercial power supply.

In the drawings, reference numerals 1A, 1B denote side frames forming a portion of the printer frame. A plurality of rotary shafts and guide shafts run in parallel between the side frames 1A and 1B. A gear train, lever, clutch and electromagnets are compactly arrayed on the outer side of the side frame 1A to control rotation of the rotary shafts. Reference numeral 2 denotes a linking board for connecting the two side frames 1A, 1B, reference numeral 3 denotes a paper guide plate which extends across the two side frames 1A, 1B, and 4A and 4B denote paper guide plates that inwardly protrude from the side frames 1A, 1B by predetermined lengths. The paper is guided and conveyed by the paper guide plates 3, 4A and 4B.

Reference numeral 5 denotes a d-c motor which selectively drives the plurality of rotary shafts that are supported between the side frames 1A and 1B, in order to turn the type carrier, to perform the hammering operation and to feed the paper as will be mentioned later in detail. Namely, the d-c motor 5 serves as a drive source for performing the above three operations and, hence, the number of drive sources is reduced thereby to reduce the power consumption and to reduce the size of the device as a whole. Reference numeral 6 denotes a first pulse motor for moving the carriage that will be mentioned later, and 7 denotes a second pulse motor for moving the hammer that will be mentioned later. The two pulse motors 6, 7, and the d-c motor 5 are disposed on the upper side of the linking board 2 in FIG. 1.

Reference numeral 8 denotes a type shaft having a non-circular shape in cross section, which is supported between the side frames 1A and 1B. A cylindrical type carrier (type drum) 9 is splinded to the type shaft 8 so as to rotate together with the type shaft 8, but may be slide longitudinally along the type shaft 8. Types 9*a* are formed in a plurality of rows on the periphery of the type carrier 9; i.e., upper and lower case letters, numerical figures, and functional symbols are formed in a plurality of rows. In this embodiment, the types are formed in five rows, and each row is equally divided into 20 segments to form 19 types 9*a* and one blank. Namely, a total of 96 letters and symbols are formed inclusive of blanks, and the blanks of each of the rows are so arrayed as to be in alignment on the same bus line of the type carrier 9.

Figure 2:
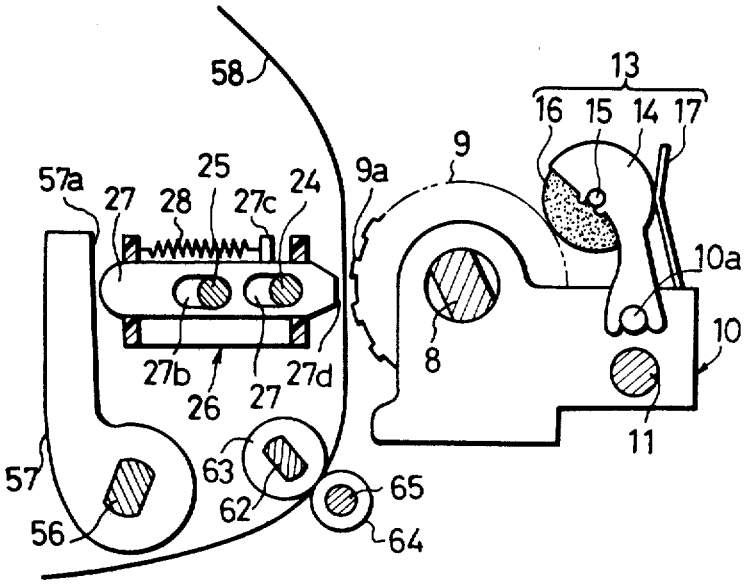
FIG. 2 is a side view showing a major portion of the mechanisms around the carriage.

Reference numeral 10 denotes a carriage holding the type carrier 9. The carriage 10 may move in the longitudinal direction along the type shaft 8 to traverse the paper while being guided by a guide shaft 11 that runs between the side frames 1A and 1B. Reference numeral 13 denotes an ink-supply means for applying ink to the types 9*a* on the periphery of the type carrier 9. As shown in FIG. 2, the ink-supply means 13 consists of an ink roller cover 14 which is detachably fitted to projections 10*a* on respective sides of the carriage 10, an ink roller 16 supported by the cover 14 via a shaft 15, and a spring 17 for lightly pressing the ink roller 16 onto the type carrier 9.

Reference numeral 18 denotes a drive pulley supported on the outer side of the side frame 1B through a shaft. A gear 18*a* formed integrally with the drive pulley 18 is in mesh with a drive pinion 6*a* of the first pulse motor 6. Reference numeral 19 denotes a wire wound on the drive pulley 18. In FIG. 1, one end of the wire 19 is fastened to the left side of the carriage 10 via guide pulleys 20, 21, and the other end of the wire 19 is fastened to the right side of the carriage 10 via a guide pulley 22. Namely, the wire 19 is fastened to the carriage 10 forming a closed loop, so that the carriage 10 moves toward the right or left in FIG. 1 depending upon a forward or reverse turn of the first pulse motor 6. Here, attention should be given to the fact that the carriage 10 is formed as a small and light-weight construction mounting the type carrier 9 and the ink-supply means 13 only. Therefore, the first pulse motor 6 may be a small one relatively low in inertia, and the carriage 10 can be moved at high speeds. Reference numeral 23 denotes a spring for tensing the wire 19.

Reference numerals 24 and 25 denote guide shafts running between the side frames 1A, 1B. The shafts 24, 25 pass through a hammer holder 26 so that it will slide traversing along these shafts. Reference numeral 27 denotes a hammer which is held by the hammer holder 26 and which moves together with the holder 26. As shown in FIG. 2, the hammer 27 has elongated holes 27*a*, 27*b* through which the guide shafts 24, 25 pass. Within a range determined by the elongated holes 27*a*, 27*b*, the hammer 27 is allowed to slide in its longitudinal direction, i.e. at right angles with respect to the direction in which the hammer holder 26 moves along the shafts 24 and 25. In this way the hammer can be moved towards the type carrier 9. Reference numeral 28 denotes a spring which stretches between the rear of the hammer holder 26 and a pin 27*c* of the hammer 27, and which always pulls the hammer 27 toward the direction away from the type carrier 9. Reference numeral 27*d* denotes a striking surface of the hammer 27, which has an area sufficient for striking only a single type 9*a* among the group of types 9*a*.

Reference numeral 29 denotes a drive pulley supported by the linking board 2 via a shaft. A gear 29*a* formed integrally with the drive pulley 29 is in mesh with a drive pinion 7*a* of the second pulse motor 7. Reference numeral 30 denotes a wire wound on the drive pulley 29. In FIG. 1, one end of the wire 30 is fastened to the left side of the hammer holder 26 via guide pulleys 31, 32 and 33, and the other end of the wire 30 is fastened to the right side of the hammer holder 26 via guide pulleys 34, 35. Namely, the wire 30 is fastened to the hammer holder 26 forming a closed loop, so that the hammer holder 26 moves toward the right or left in FIG. 1 depending upon the forward or reverse turn of the second pulse motor 7. Here, the hammer holder 26 is constructed in a small size and in a reduced weight, and mounts a light-weight hammer 27. Therefore, the second pulse motor 7 for driving the hammer holder may be smaller and lighter than the first pulse motor 6. Moreover, the hammer 7 can be operated at high speeds due to the low inertia of the hammer and its holder. Reference numeral 36 denotes a spring for tensing the wire 30.

Reference numeral 37 denotes a drive gear which is loosely mounted on a portion of the type shaft 8 extending beyond the side frame 1A, so as to rotate relative to the shaft 8. The drive gear 37 is coupled to a drive pinion 5*a* of the d-c motor 5 via intermediate gears 38, 39 and 40, and is always rotated in one direction by the d-c motor 5 which always turns in one direction at a constant speed while the printing operation is being carried out. Reference numeral 41 denotes a ratchet which is secured to the end of the type shaft 8, and which has 20 equally divided teeth. Reference numeral 42 denotes a first clutch disposed between the ratchet 41 and the drive gear 37, and which controls the transmission of rotation between the gear 37 and the ratchet 41. Reference numeral 43 denotes a cam assembly which is loosely mounted on the type shaft 8 to rotate relative thereto, and which consists of a first cam 44, a second cam 45 and a third cam 46. Reference numeral 47 denotes a second clutch disposed between the cam assembly 43 and the drive gear 37, and which controls the transmission of rotation between the drive gear 37 and the cam assembly 43.

Reference numeral 48 denotes a first electromagnet for selecting the turning position of the type carrier 9. The first electromagnet 48 drives an operation rod 49 which controls the first and second clutches 42, 47. The operation rod 49 is rotatably supported by the side frame 1A, and has operation ends spaced apart. One operation end 49*a* is adapted to be engaged with the ratchet 41, and another operation end 49*b* is adapted to be engaged with a cam groove 44*a* of the first cam 44 in the cam assembly 43, as will be discussed below with reference to the FIGS. 3(*a*), 3(*b*) and 3(*c*). The operation rod 49 works as a so-called mechanical flip-flop. That is, when one operation end 49*a* is engaged with the ratchet 41, the other operation end 49*b* is separated away from a cam groove 44*a* of the first cam 44 and, on the other hand, when one operation end 49a is separated away from the ratchet 41, the other operation end 49b engages with a cam groove 44a of the first cam 44. Further, the operation rod 49 is urged by a spring which is not shown to turn in the clockwise direction (direction of arrow A) in FIG. 3(*a*) with a support shaft 50 as a center. When one operation end 49b is engaged with a cam groove 44a of the first cam 44, and the other operation end 49a is separated from the ratchet 41 being urged by the spring, the first clutch 42 is under the condition to transmit the rotational force of the gear 37 to the shaft 8 (hereinafter referred to as ON state) and the second clutch 47 is under the condition not to transmit the rotational force of the gear 37 to the cam assembly 43 (hereinafter referred to as OFF state), such that the rotational force of the d-c motor 5 is transmitted to the ratchet 41 and type shaft 8 only. On the other hand, when the operation rod 49 is rotated in the counterclockwise direction in FIG. 3 as a result of actuation of the first electromagnet 48 against the spring, the operation end 49b separates from a cam groove 44a of the first cam 44, the operation end 49a engages with the ratchet 41, the first clutch 42 assumes the OFF state, and the type shaft 8 ceases to rotate.

Reference numeral 51 denotes a second electromagnet. An operation end 52a of an operation rod 52 driven by the electromagnet 51 is adapted to be engaged with a cam groove 44a of the first cam 44. Further, the operation rod 52 is urged by a spring which is not diagrammed to turn in the clockwise direction (in the direction of arrow B) in FIG. 3(*a*) with a support shaft 53 as a center. The operation rod 52 works in cooperation with the operation end 49b of the operation rod 49 to control the second clutch 47. The second clutch 47 assumes the ON state only when both of the operation ends 49b, 52a of the operation rods 49, 52 are separated from the cam groove 44a of the first cam 44, and whereby the rotational force of the drive gear 37 (d-c motor 5) is transmitted to the cam assembly 43.

Figure 3A:
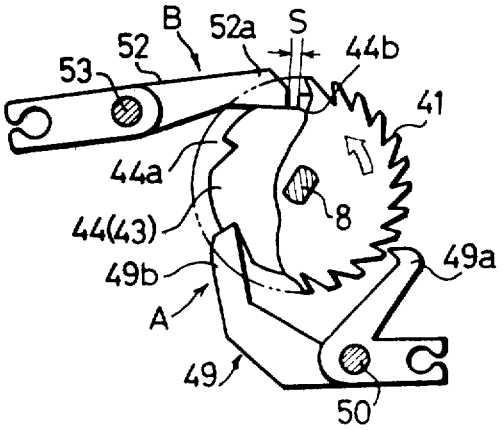
FIGS. 3(*a*), 3(*b*) and 3(*c*) illustrate operations among the ratchet, the first cam and the lever.
Figure 3B:
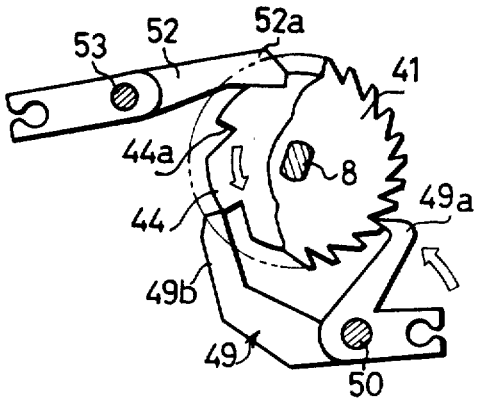
Figure 3C:
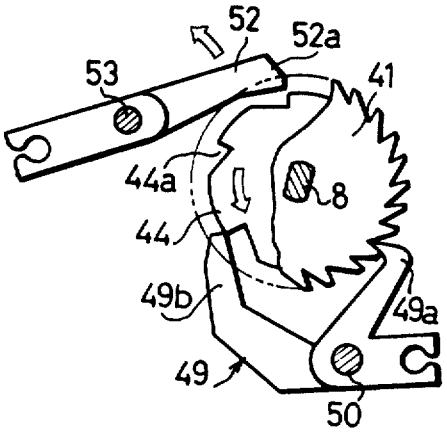

The first cam 44 includes several cam grooves 44a spaced equally around its periphery, and in the present embodiment, six cam grooves 44a are provided. When the operation end 49b of the operation rod 49 is engaged with one of these cam grooves 44a, it fits therewithin without forming any clearance, as shown in FIG. 3(*a*), and when the second clutch 47 is under the OFF state, the operation end 52a of the operation rod 52 falls on another cam groove 44a of the first cam 44, but maintains a small gap S relative to a perpendicular end surface 44b of the cam groove 44a, as shown in FIG. 3(*a*). Under this condition, if the first electromagnet 48 is operated responsive to a printing instruction to bring the operation end 49a of the operation rod 49 into engagement with the ratchet 41, and if the first clutch 42 is rendered to assume the OFF state to stop the type shaft 8 (type carrier 9) at a desired position, the other operation end 49b of the operation rod 49 separates away from a cam groove 44a of the first cam 44. Consequently, the first cam 44 is liberated, the second clutch 47 assumes the ON state for only a brief period of time, and the first cam 44 turns in the direction of the arrow in FIG. 3(*b*) by a small amount permitted by the above-mentioned small gap S. The second clutch 47 assumes the OFF state at the moment when the operation end 52a of the operation rod 52 comes into contact with the perpendicular end surface 44b of a cam groove 44a of the first cam 44, and the first cam 44 (cam assembly 43) ceases to rotate.

Accordingly, if the electric current is allowed to flow even for a short period of time into the first electromagnet 48 which selects the stop position of the type carrier 9, the operation end 49b of the operation rod 49 comes into contact with the outer periphery of the first cam 44 as shown in FIG. 3(*b*) when the flow of current to the first electromagnet 48 is interrupted, and the other operation end 49a engages with the ratchet 41 to maintain the first clutch 42 in the OFF state.

Under this condition, termination of the shift of the type carrier 9 and the hammer 27 is confirmed relying upon the printing instruction. Then, as the second electromagnet 51 is excited and the operation end 52a of the operation rod 52 separates away from a cam groove 44a of the first cam 44, the second clutch 47 assumes the ON state. Therefore, the first cam 44 (i.e., cam assembly 43) turns in the direction of the arrow in FIG. 3(*c*) until the operation end 49b of the operation rod 49 engages with the next cam groove 44a of the first cam 44. In this embodiment, the first cam turns by 60° minus the angle that corresponds to the small gap S, i.e., turns about one-sixth of a turn. As the operation end 49b of the operation rod 49 engages with the next cam groove 44a of the first cam 44, the other operation end 49a of the operation rod 49 separates away from the ratchet 41. At this moment, the second electromagnet 51 has been de-energized. Therefore, the operation end 52a of the operation rod 52 engages with a cam groove 44a of the first cam 44 as shown in FIG. 3(*a*). The second clutch 47 assumes the OFF state, the first clutch 42 assumes the ON state, and the ratchet 41 (type shaft 8) rotates in the direction of the arrow.

Here, the type carrier 9 and the hammer 27 are moved in the shifting direction by the pulse motors 6, 7, and the proper shift of the hammer to place its striking surface 27d opposite a desired type is selected during the the selection of a stop position of the type carrier 9 by the first electromagnet 48: which selection will finish earlier by an arbitrary time period. To reduce the consumption of electric power, however, the electric current is carried to the first and second electromagnets 48, 51 for only brief periods of time, and the second electromagnet 51 is excited after the first electromagnet 48 is excited. That is, even when the shift is finished prior to the selection of the stop position, the electric current is allowed to flow into the second electromagnet 51 after the selection of the stop position (excitation of the first electromagnet 48) has been finished, so that the second electromagnet 51 need not be maintained in the excited state from the moment the shifting position is selected to the moment the first electromagnet 48 is excited. On the contrary, when the selection of stop position is finished, first, the operation rod 49 of the first electromagnet 48 will have been transferred to the state of FIG. 3(*b*) even when the flow of current to the first electromagnet 48 is interrupted as mentioned earlier. Immediately after the second electromagnet 51 is energized, therefore, the second clutch 47 assumes the ON state.

The rotating position of the type carrier 9 is detected by a detector which consists of a disc 54 fastened to the type shaft 8 and a photosensor 55. A reference position detection signal of the type carrier 9 and a detection signal corresponding to each of the type positions are produced by the detector. Relying upon the signals from the detector and a signal which is produced based upon the printing content, the first electromagnet 48 is excited just before a desired type 9a reaches the printing position, to stop the desired type 9a at the printing position. On the other hand, shifted positions of the type carrier 9 and the hammer 27 as detected by counting the pulses applied to the pulse motors 6, 7 which shifts the type carrier 9 and the hammer 27. Reference positions of the carriage 10 and the hammer holder 26 are detected by a detector (which is not shown, but which may be composed of a leaf switch, a reed switch or the like) that detects home positions (end position in the carrying direction) of the carriage 10 and the hammer holder 26, and the pulses for driving the pulse motors 6, 7 are added or subtracted relying upon the reference positions.

In FIG. 1, reference numeral 56 denotes a hammer drive shaft which is supported between the side frames 1A and 1B, and which has a hammer drive member 57 secured thereto to push the hammer 27 toward the type carrier 9. The hammer drive member 57 extends along the entire region in which the hammer 27 will move. When the hammer drive shaft 56 is rotated, the striking portion 57*a* pushes the rear end of the hammer 27 so that it is pressed against a desired type 9*a* on the type carrier 9 via a paper 58 to effect the printing (see FIG. 2). Rererence numeral 59 denotes a gear fastened to the hammer drive shaft 56 that outwardly extends beyond the side frame 1A.

Figure 4:
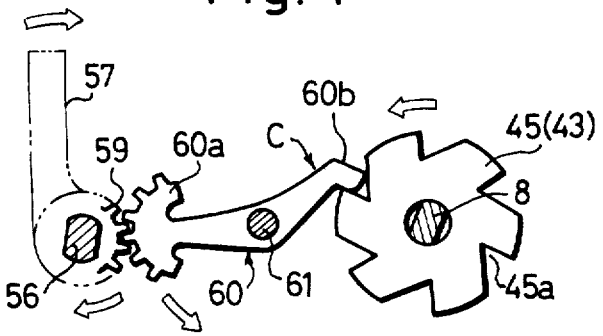
FIG. 4 is a illustrates a relation between the second cam and the hammer drive shaft.

Reference numeral 60 denotes a lever supported by the side frame 1A via a shaft 61. With the support shaft 61 as a boundary, the lever 60 has, on one side, a sector wheel 60*a* that meshes with the gear 59 and has, on the other side, an engaging piece 60*b* that engages with the second cam 45 of the cam assembly 43. The lever 60 is urged by a spring which is not shown to turn in the clockwise direction (direction of arrow C) in FIG. 4. When the second xam 45 is not turned (i.e., when the second clutch 47 is in the OFF state and the cam assembly 43 is halted), the engaging piece 60*b* engages with the cam groove 45*a* of the second cam 45 as shown in FIG. 4. The cam grooves 45*a* of the second cam 45 have been formed in the same number as the cam grooves 44*a* of the first cam 44 and at positions corresponding to the cam grooves 44*a* of the first cam 44, but being tilted toward the direction opposite to the cam grooves 44*a* of the first cam 44.

As mentioned above, therefore, the second clutch 47 assumes the ON state under the condition in which a desired type 9*a* of the type carrier 9 is opposed to the hammer 27 and is stopped at that position. When the cam assembly 43, i.e., the second cam member 45 is rotated, the engaging piece 60*b* rises on the periphery of the second cam 45, whereby the lever 60 turns in the direction of the arrow in FIG. 4 (in the counterclockwise direction), and the sector wheel 60*a* of the lever 60 rotates the gear 59 in the direction of the arrow (clockwise direction). As the gear 59 rotates, the hammer drive member 57 of the hammer drive shaft 56 which rotates together with the gear 59 is turned to push the hammer 27 onto the type carrier 9, so that a desired type 9*a* is pressed onto the paper 58 to effect the printing.

The cam assembly 43 stops after having rotated one-sixth of a turn (the second clutch 74 assumes the OFF state) as mentioned above. When the printing operation is finished, the engaging piece 60*b* of the lever 60 falls on the next cam groove 45*a* of the second cam 45 being urged by the spring. The lever 60, therefore, rotates clockwise in FIG. 4 with the support shaft 61 as a center, and the gear 59, i.e., the hammer drive member 57 rotates counterclockwisely. The hammer drive member 57 resumes the state shown in FIG. 4. It will be understood that the hammer 27 returns to the initial position being urged by the spring 28.

In FIG. 1, reference numeral 62 denotes a paper-feed shaft. Although FIG. 1 shows only those portions that are outwardly extended beyond the side frames 1A, 1B, the paper-feed shaft 62 penetrates through the side frames 1A, 1B and is supported by them. A paper-feed roller 63 is fitted to the paper-feed shaft 62 as shown in FIG. 2; the paper 58 is conveyed by the turn of the paper-feed roller 63. In FIG. 2, furthermore, reference numeral 64 denotes a driven roller which is resiliently pressed onto the paper-feed roller 63. The paper 58 is held between the driven roller 64 and the paper-feed roller 63. Although not diagrammed, the support shaft 65 of the driven roller 64 is extended by a predetermined amount beyond the side frame 1B. The driven roller 64 can be manually moved to a position separated away from the paper-feed roller 63 via a suitable lever that is coupled to the extended portion of the roller 64; i.e., the paper 58 can be released or placed in position. In FIG. 1, furthermore, a gear 66 is fastened to the paper-feed shaft 62 that outwardly extends beyond the side frame 1B. Depending upon the forward turn or reverse turn of a knob 67 which has a gear 67*a* and which can be manually pulled or pushed to engage with the gear 66, the paper-feed shaft 62 is rotated forwardly or reversely so that the paper 58 can be manually fed forwardly or backwardly.

Figure 5:
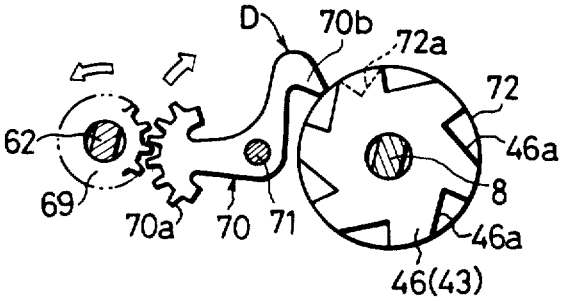
FIG. 5 is a shows a relation among the third cam, the paper-feed control cam and the paper-feed shaft.

In FIG. 1, a gear 69 is attached via a one-way clutch 68 to the portion of the paper-feed shaft 62 that is outwardly extended beyond the side frame 1A. Reference numeral 70 denotes a lever for controlling the turn of the gear 69, and which is rotatably supported by the side frame 1A. As shown in FIG. 5, the lever 70 has, on its one side, a sector wheel 70*a* that meshed with the gear 69, and has, on the other side, an engaging piece 70*b* that engages with the third cam 46 of the cam assembly 43 and with a paper-feed control cam 72 that will be mentioned below, with the support shaft 71 as a center. The paper-feed control cam 72 is attached to the type shaft 8, and is disposed adjacent to the third cam 46. The paper-feed control cam 72 has a single cam groove 72*a* which corresponds to the blank portion of the type carrier 8. The third cam 46 has cam grooves 46*a* in a number which corresponds to the number of cam grooves 44*a* of the first cam 44. Further, the cam grooves 46*a* of the third cam 46 are formed being tilted in the direction opposite to the cam grooves 44*a* of the first cam 44.

The lever 70 is urged by a spring which is not shown to turn in the clockwise direction in FIG. 5 (direction of arrow D). When the second clutch 47 is in the OFF state and the third cam 46 (cam assembly 43) is at rest, the engaging piece 70*b* of the lever 70 is in contact with the circumference of the third cam 46. Under this condition, if shifts of the type carrier 9 and the hammer 27 are selected, rotating position of the type carrier 9 is selected, the second electromagnet 51 is excited, and the second clutch 47 assumes the ON state, the cam assembly 43 rotates by about one-sixth of a turn. During this period, the cam groove 46*a* of the third cam 46 moves to a position opposed to the engaging piece 70*b* of the lever 70. However, the engaging piece 70*b* is also in contact with the periphery of the paper-feed control cam 72 and is not allowed to turn and cannot fall on the cam groove 46*a* of the third cam 46 unless the cam groove 72*a* of the paper-feed control cam 72 stops at a position opposed to the engaging piece 70*b*.

To feed the paper, therefore, the rotating position of the type carrier 9 should be so selected that the cam groove 72*a* of the paper-feed control cam 72 stops at a position opposed to the engaging piece 70*b* of the lever 70, i.e., so that the blank portion of the type carrier 9 stops at the printing position, and then the second clutch 47 should be rendered to assume the ON state. Then, when the cam groove 46*a* of the third cam 46 reaches a position opposed to the engaging piece 70*b* accompanying the turn of the cam assembly 43, the engaging piece 70*b* falls on the cam groove 46*a* of the third cam 46 and on the cam groove 72*a* of the paper-feed control cam 72 being urged by a spring which is not shown. The lever 70 rotates in the direction of arrow (in the clockwise direction) in FIG. 5. Therefore, the gear 69 which is in mesh with the sector wheel 70*a* of the lever 70 rotates in the direction of arrow (in the counter-clockwise direction) in FIG. 5, and the paper-feed shaft 62 rotates via the one-way clutch 68 to move the paper 58 by an amount which corresponds to the space of one line. As the second clutch 47 assumes the OFF state and the cam member 43 halts at the moment when the cam assembly 43 has rotated by about one-sixth of a turn, the engaging piece 70*b* of the lever 70 rides on the periphery of the third cam 45, whereby the lever 70 rotates in the counter-clockwise direction in FIG. 5, and the gear 69 turns clockwisely to assume the initial position. In this case, however, the paper-feed shaft 62 is not turned since the gear 69 and the paper-feed shaft 62 are coupled together via one-way clutch 68.

In feeding the paper as mentioned above, the lever 60 turns and the hammer 27 is driven by the hammer drive member 57. However, since the blank portion of the type carrier 9 is opposed to the hammer 27, no symbol is printed on the paper 58. In this embodiment, furthermore, the blank portion is stopped at the printing position. However, if shift positions of the hammer 27 and the type carrier 9 are so controlled that the paper is fed at a position at which the hammer is not opposed to the type carrier 9, the cam groove 72*a* of the paper-feed control cam 72 may be formed at any position that corresponds to the type other than the blank portion.

The operation of the thus constructed printer is described below although it may be already obvious from the above description.

Responsive to the printing instructions, the type carrier 9 and the hammer 27 are shifted to desired positions by the first and second pulse motors 6 and 7. The first pulse motor 6 and/or the second pulse motor 7 are so controlled that a desired type of the type carrier 9 is opposed to the hammer 27 at a desired position on the paper 58. The stop position of the type carrier 9 rotated by the d-c motor 5 is then selected by the first electromagnet 48, the second clutch 47 assumes the ON state being actuated by the second electromagnet 51, the cam assembly 43 is rotated by a predetermined angle, the lever 60 is driven by the second cam 45 of the cam assembly 43, and the hammer drive member 57 pushes the hammer 27 to effect the printing. As the printing of one line is finished through the above-mentioned series of shift selections, selections of positions of the type carrier 9 and hammering operations, the second electromagnet 51 is excited following the selection of brank portion of the type carrier 9, and the lever 70 is turned to feed the paper.

The first pulse motor 6 and/or the second pulse motor 7 only are energized during the spacing operation, back-spacing operation, half-pitch spacing operation or half-pitch back-spacing operation, that does not involve the printing operation.

The above embodiment has dealt with the printer of the type of inked roller. The invention, however, can be adapted to the printers of the type employing an inked ribbon. According to the invention, furthermore, resilient strips may be arrayed among the type trains of the type carrier 9 to prevent the so-called side printing. Namely, the present invention can be modified in a variety of ways within a scope which does not depart from the technical idea covered in claims of the present application.

According to the present invention as illustrated in detail in the foregoing, the carriage of a very light weight and the hammer holder can be shifted swiftly by the first and second pulse motors. Further, the type carrier is turned and the hammering is effected by a single d-c motor. Consequently, it is possible to reduce the number of drive sources, and to provide a small and light-weight serial printer which is simply constructed as a whole, and which can be suitably adapted to portable electric-powered typewriters and to the output printers of personal computers.

What is claimed is:

1. In a serial printer having a plurality of types formed on the periphery of a cylindrical type carrier, said type carrier being held by carriage adapted to be moved across the paper, and means for pressing a desired type against said paper to effect printing, the improvement comprising:

(a) a type shaft splined to said type carrier and lying parallel to the direction of movement of said carriage;

(b) said means for pressing including a hammer lying opposite said type carrier via said paper and having a striking surface of an area sufficient for striking only one of said types, said hammer being adapted to be moved through a predetermined range in a direction parallel with the movement of said carriage;

(c) means including a hammer drive member lying along said range of movement of said hammer for driving said hammer in the direction of said type carrier;

(d) means including a first pulse motor for moving said carriage;

(e) means including a second pulse motor for moving said hammer;

(f) means including a d-c motor rotating said type shaft and said hammer drive member, alternatively;

(g) means including a first clutch for controlling the transmission of rotation between said type shaft and said d-c motor;

(h) means including a second clutch for controlling the transmission of rotation between said hammer drive member and said d-c motor;

(i) means including a first electromagnet for selecting the stop position of said type carrier;

(j) a cam adapted to be controlled by operation of said first electromagnet; and (k) means including a second electromagnet for controlling said cam after the stop position of said hammer has been selected.

2. A serial printer according to claim 1, wherein said d-c motor also serves as a drive source for feeding the paper.

3. A serial printer according to claim 2, including means for feeding the paper by selecting a particular rotation stop position of the type carrier.

4. A serial printer according to claim 2, including a manual paper-feed means to manually turn a shaft for feeding paper.

5. A serial printer according to claim 1, wherein said second clutch transmits rotational force only when both said first electromagnet and said second electromagnet are actuated.

6. A serial printer according to claim 1, wherein said cam is adapted to be rotated by a small amount to prevent an operation rod of the first electromagnet from being engaged with a cam groove of said cam when the operation rod of said first electromagnet is liberated from a cam groove of said cam before an operation rod of second electromagnet is liberated from the cam groove of said cam.

* * * * *